United States Patent [19]

Gruaz

[11] 4,365,559

[45] Dec. 28, 1982

[54] MUNITION ROUND FOR FIREARMS

[76] Inventor: Eric Gruaz, 4, avenue Marechal Foche, Lyon 6eme, France

[21] Appl. No.: 140,826

[22] Filed: Apr. 16, 1980

[30] Foreign Application Priority Data

Apr. 17, 1979 [FR] France ..... 79 10417

[51] Int. Cl.[3] ..... F42B 11/00

[52] U.S. Cl. ..... 102/439; 102/430; 102/466; 102/501

[58] Field of Search ..... 402/430–444, 402/464–468, 501–517

[56] References Cited

U.S. PATENT DOCUMENTS 911,796 2/1909 Wratzke ..... 102/430
1,307,419 6/1919 Rogers ..... 102/501
2,616,371 12/1952 Catlin ..... 102/464
2,862,446 12/1958 Ringdal ..... 102/466

FOREIGN PATENT DOCUMENTS 2205755 8/1973 Fed. Rep. of Germany ..... 102/430

*Primary Examiner*—Harold J. Tudor
*Attorney, Agent, or Firm*—Karl F. Ross

[57] ABSTRACT

A munition or round for a firearm comprises a shell casing of synthetic resin material formed internally with a plurality of axially spaced annular ribs which snap into corresponding grooves in the shank of the bullet. The bullet shank is also formed with axially extending grooves to vent the space between the base of the bullet and the bottom of the casing, this space receiving a moist firing charge whose solvent vaporizes through the gaps formed by the axially extending groove.

3 Claims, 8 Drawing Figures

MUNITION ROUND FOR FIREARMS

FIELD OF THE INVENTION

My present invention relates to a cartridge or munition round for firearms.

BACKGROUND OF THE INVENTION

Cartridges for firearms, such as rifles and hand guns, generally comprise a metallic casing or shell in which a bullet is received, a firing charge being disposed between the base of the bullet and the bottom of the casing. When the cartridge is fired, the charge explodes to drive the bullet out of the barrel of the weapon.

It has been proposed heretofore to fabricate the cartridge from a casing of a synthetic-resin material in order to reduce the cost of each round and there have even been proposals to make the bullet out of synthetic material.

However, these attempts at lowering the fabrication cost per round have confronted problems which in part result from unsatisfactory techniques in anchoring the bullet in the shell or casing, or in fabricating the round in a safe manner. Particularly the problems of inserting a metal bullet into a casing or shell of synthetic-resin material has caused such systems to be avoided in large measure.

It is also known to increase the safety of munitions manufacture to introduce the charge in a moist state, i.e. wherein the explosive grains are suspended in a vaporizable liquid, hereinafter referred to as a solvent for convenience. Thus, the charge can be introduced into the casing in a moist state, thereby eliminating the problem of handling the charge when it is most dangerous and likely to explode. However, it is not generally possible to insert the bullet while the charge is still moist, i.e. prior to evaporation of the solvent or other stabilizer utilized to avoid explosion.

OBJECTS OF THE INVENTION

It is the principal object of the present invention to provide a low cost munitions round or cartridge for fireamrs whereby the disadvantages of earlier cartridges are avoided.

Another object is to provide a low-cost cartridge which can be assembled or fabricated conveniently and economically in a safe and reproducible manner.

SUMMARY OF THE INVENTION

These objects and others which will become apparent hereinafter are attained, in accordance with the present invention, by providing a shell or casing of synthetic material, usually an injection-molded synthetic resin, which is formed internally with a plurality of axially spaced inwardly projecting annular ridges or ribs, and a bullet having a shank received in the shell and formed with corresponding externally open annular axially spaced grooves adapted to receive the ribs so that the shank of the bullet can be snap-fitted into the shell.

According to the invention, moreover, the shank is formed with at least one axial groove reaching to the base of the bullet and dimensioned to permit the solvent or stabilizer of the explosive charge, as it evaporates, to be vented from the space between the base of the bullet and the bottom of the casing in which the charge is disposed in a moist state.

The casing or shell can be molded in a conventional manner and the charge is then introduced into the bottom of the casing in a moist condition and preferably in a humid environment precluding all possibility of spontaneous explosive.

Thereafter, the bullet is forced into the shell or casing and is gripped therein by the ribs which snap into the peripheral grooves on the bullet.

The or each of the axial grooves permit communication between the charge compartment and the ambient atmosphere over the length of each axial groove thereby allowing the vapors of the charge stabilizer to escape.

The bullet is advantageously formed from lead and can be produced by forcing a predetermined slug of lead into a suitably shaped mold to provide both the head and the shank of the bullet. Thereafter, while the head is held, a tool having a plurality of cutters is forced axially along the shank to cut the axial grooves, and then rotated about an axis corresponding to the axis of the bullet to cut the circumferential or peripheral grooves.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
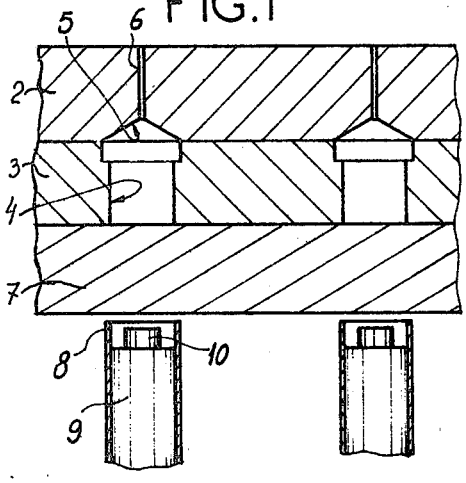
FIG. 1 is a transverse cross-sectional view through a portion of a mold for producing bullet blanks in accordance with the present invention.
Figure 2:
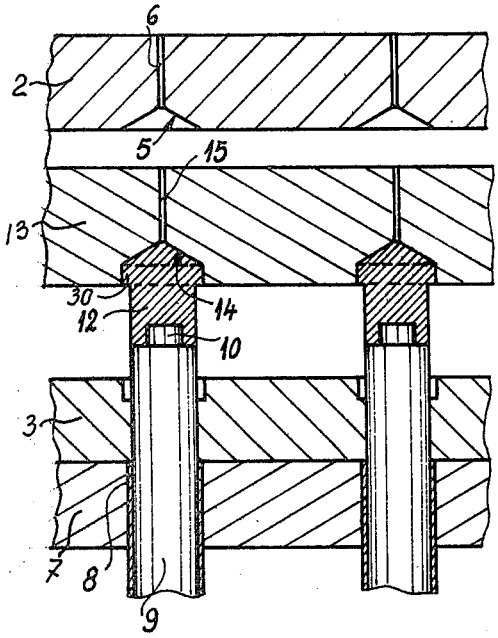
FIG. 2 is a similar view illustrating the mounting of the bullets by the head in the holder preparatory to the formation of the grooves.
Figure 5:
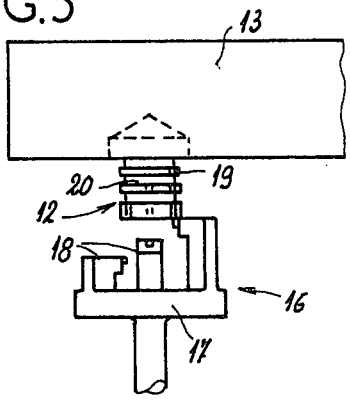

In FIGS. 1 and 2 I have shown an apparatus for fabricating bullet blanks according to the invention. The bullets are formed in a two-part mold consisting of an upper plate 2 and a lower plate 3 formed respectively with frustoconical cavities 5 and cylindrical passages 4 which register with one another to produce a respective cavity having a formed passage 6 and of the shape of the desired bullet blank. Each bore 4 is aligned axially with a punch 8 the same diameter and a ram 9 having a projecting portion 10.

A slab of lead is disposed along the bottom surface of the mold 2, 3 and the punch 8 is driven upwardly to cut a cylindrical slug or disk or lead from the slab 7, this slug being forced into the mold cavity 4, 5 by the ram or plunger 9 whose diameter corresponds to the diameter of the bore 4. The resulting bullet blank is shown at 12 in FIG. 2 and has the shape of the mold cavity.

Figure 3:
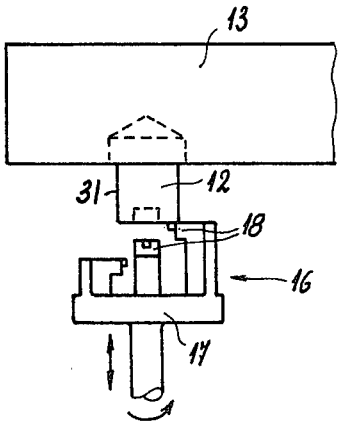
FIGS. 3 through 5 are diagrammatic elevational views of three phases in the formation of the grooves.

Upon opening of the mold by separating the plates 2 and 3, the slug 12 can be driven out of plate 3 by the plunger 9 and is retained in place by the projection 10. The head 30 of the slug is then inserted into a correspondingly shaped cavity 14 in a holding plate or transfer plate 13 and is held therein by evacuation of this cavity through a passage 15. The transfer plate carrying all of the blanks 12 is then shifted so that the blanks are aligned with grooving tools which can be shifted axially (upwardly and downwardly) and rotated as represented by the arrows shown in FIG. 3.

The tool 16 comprises a base or support 17 carrying, in the embodiment shown, three cutters 18 which project inwardly and are staggered at different axial levels while being angularly spaced. The spacing between the two cutters 18 which are furthest from one another is less than the length of the shank of the bullet shown at 31.

Figure 4:
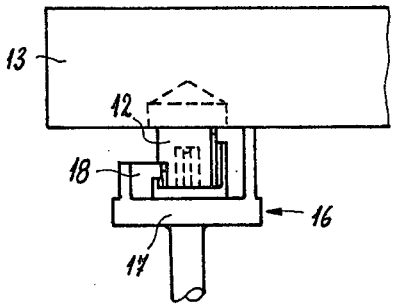
Figure 8:
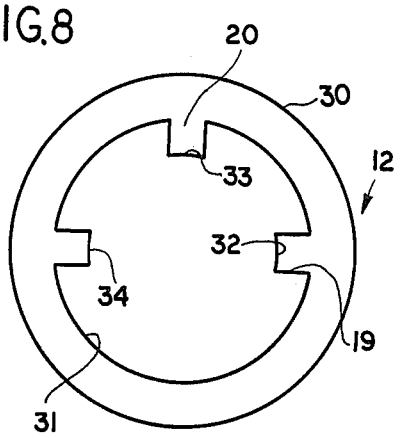
FIG. 8 is a bottom view of the bullet of FIGS. 6 and 7.
Figure 6:
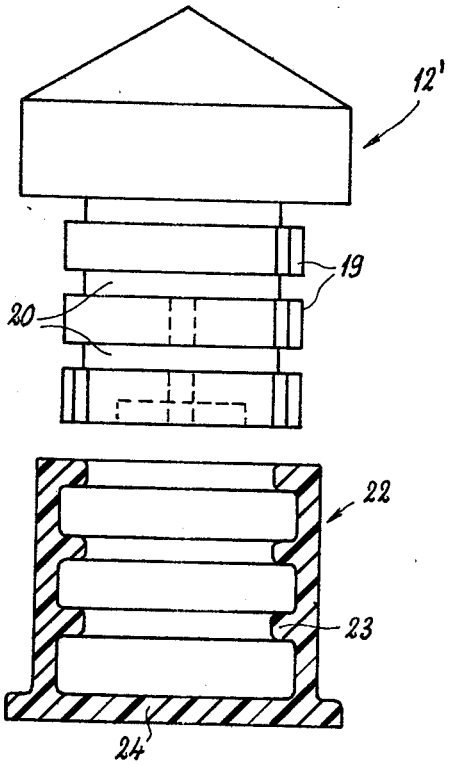
FIG. 6 is an exploded view of the bullet and the casing, the latter being shown in section.
Figure 7:
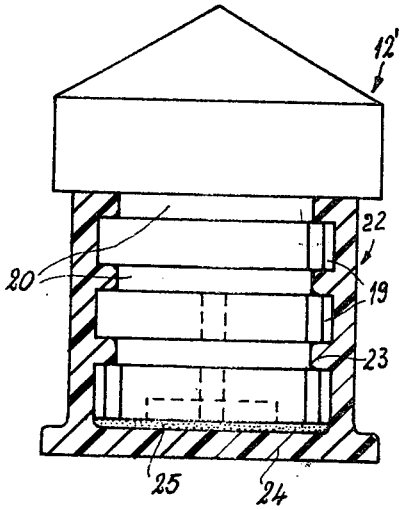
FIG. 7 is a view, with the casing broken away, showing the assembled cartridge.

The tool 16 is shifted axially upwardly (FIG. 4) to cut three grooves 19 in the shank, e.g. the three grooves 32, 33 and 34 shown in FIG. 8.

The groove 32 extends the full length of the shank while grooves 33 and 34 merely extend into the next two lower circumferential grooves 20.

The tool is then rotated, e.g. by being connected to a motor, to cut the circumferential grooves 20 which are adapted to receive the inwardly projecting ribs 33 on the shell casing 22.

The plate 13 then carries the bullets 12 into axial alignment with the previously molded casings 22 of synthetic resin material, each of which has been provided with a quantity 25 of explosive being in the moist state. The shanks of the bullets are then pressed into the casing and a snap-fit is provided between the ribs 23 and the grooves 20.

The solvent or stabilizer evaporates through the axial grooves 19.

It will be apparent from the foregoing that the munitions rounds can be produced rapidly and safely at relatively low cost because the casings can be composed of synthetic material without any danger of difficulty in securing the bullets in place. The safety of fabrication is enhanced by the fact that the bullets are mounted while the charge is in its moist state.

Naturally, bullets of different shapes can be provided and the bullets can be composed of synthetic material as well. Furthermore, the number of interfitting grooves and ribs on the bullets and casings can be varied. Finally, instead of vacuum retention means for the heads of the bullets, they can be held by mechanical means such as ribs onto which the bullets are forced.

I claim:

1. A cartridge for a firearm comprising:

a bullet having a head and a shank extending axially from said head, said shank being formed with at least one axially extending groove and a plurality of circumferential grooves having a given depth;

a casing of synthetic material receiving said shank and provided with a plurality of internally projecting annular ribs of a number equal to the number of said circumferential grooves and received therein, the said ribs extending into said circumferential grooves a distance less than said given depth, bullet and the casing defining a space at the bottom of said casing which is vented to the ambient atmosphere through said axial groove which extends from said space to said plurality of circumferential grooves; and an explosive charge received in said space and adapted to be introduced into said casing in a moist state.

2. The cartridge defined in claim 1 wherein a plurality of axial grooves are formed in angularly spaced relationship on said shank, each of said axial grooves terminating at a respective one of said circumferential grooves.

3. The cartridge defined in claim 2 wherein said bullet is formed of lead.

* * * * *